US005474411A

United States Patent [19]

Schoenfeld et al.

[11] Patent Number: 5,474,411

[45] Date of Patent: Dec. 12, 1995

[54] MULTISTORY STRUCTURE FOR CHEMICAL PLANTS

[75] Inventors: Reinhard Schoenfeld, Gruendau; Juergen Hofmann, Bad Orb, both of Germany

[73] Assignee: Nukem GmbH, Azenau, Germany

[21] Appl. No.: 64,651

[22] Filed: May 21, 1993

[30] Foreign Application Priority Data

Jun. 5, 1992 [DE] Germany ..... 42 18 615.3

[51] Int. Cl.[6] ..... B65G 1/02

[52] U.S. Cl. ..... 414/266; 52/234; 52/236.3; 141/369; 141/232; 454/49; 454/370; 55/529

[58] Field of Search ..... 414/266, 267, 414/273, 274, 787, 275, 276, 277, 279, 280, 281, 282, 283, 284, 286, 287, 288, 227, 252, 253, 254, 255, 261, 264; 52/234, 236.3; 141/369, 370, 371, 231, 232, 233; 55/529; 454/49, 370

[56] References Cited

U.S. PATENT DOCUMENTS

| | | | |
|---|---|---|---|
| 1,914,342 | 6/1933 | Larsen | 414/287 X |
| 3,675,799 | 7/1972 | Steed et al. | 414/264 X |
| 5,238,348 | 8/1993 | Reimer | 414/264 X |

FOREIGN PATENT DOCUMENTS

| | | | |
|---|---|---|---|
| 0366559 | 2/1990 | European Pat. Off. . | |
| 2438724 | 9/1980 | France . | |
| 2653812 | 3/1991 | France . | |
| 1431582 | 3/1969 | Germany | 414/266 |
| 3729139 | 10/1988 | Germany . | |
| 4218615 | 7/1993 | Germany . | |

OTHER PUBLICATIONS

Scheffler, Die Technik, vol. 1, Jan. 1970, pp. 13–17.

*Primary Examiner*—Frank E. Werner
*Attorney, Agent, or Firm*—Beveridge, DeGrandi, Weilacher & Young

[57] ABSTRACT

A structure found of several structural segments with superposed rooms is used for chemical plants which permit a very flexible method of production with rapid product changes. The plant components together with associated connections are housed on mobile frames in the rooms so that the plant components can be simply and rapidly replaced.

3 Claims, 2 Drawing Sheets

MULTISTORY STRUCTURE FOR CHEMICAL PLANTS

INTRODUCTION AND BACKGROUND

The present invention relates to a multistory structure for chemical plants, especially for plants for the production of pharmaceutical products, including a plurality of adjacently arranged structural segments and the open areas necessary for the access to these structural segments, which structural segments include a plurality of superposed rooms or spaces which contain all plant components necessary for the production of the products to be produced and are provided with access openings.

Customarily, fabrication plants are used for the production of chemical substances which consist of a structure in which the necessary plant parts and plant components are permanently connected to the building. Even among each other, the plant components are connected permanently to each other via pipelines and other supply systems. One-story buildings have the advantage that they are more economical to build and are very adaptable to changing production tasks ("Die Technik", No. 1, 1970, pp. 13–17).

For example, DE-PS 37 29 139 teaches multistory structures in which the finishing stations of a chemical production process are located in different stories and the rooms comprise openings for the transport of materials.

In the known fabrication plants for producing chemical products each plant component is permanently connected to the building and to a supply and removal system. Necessary casings like those necessary, for example, for toxic substances are permanently installed. Such plants are therefore not very flexible and are uneconomical for product changes since the replacement of plant components necessitates a great expense. Expensive rinsing and cleansing operations are necessary even for the supply and removal lines in order to achieve a high degree of purity of the newly produced substances after a product change.

SUMMARY OF THE INVENTION

It is an object of the present invention to develop a multistory structure for chemical plants, especially plants for the production of pharmaceutical products, which include a plurality of adjacently arranged structural segments and the open areas necessary for the access to these structural segments. The structural segments are composed of several superposed rooms or spaces all of which contain plant components necessary for the production of the products to be produced and are provided with access openings. This structure is intended to make possible a very flexible product change or production change with little expenditure of personnel and time and to make possible a simple cleaning of the necessary pipelines, apparatuses and, if necessary, also of the rooms.

In achieving the above and other objects, on feature of the invention resides in multistory arrangement wherein at least a part of the plant components are housed together with the associated connections for the supply of media and energy as well as for used liquid and gaseous substances and casings on mobile frames which are transported via the access openings in and out of the rooms. According to the invention, the structure contains, in addition to the structural segments for the plant components, one or more multistory structural segments in which the auxiliary devices such as ventilation, exhaust-air purification, supply lines for energy and reaction media and for preparation of solvents and chemicals are housed for the entire structure. The supply lines run vertically within these structural segments and are connected to horizontal ring lines which are arranged in tiers in the rooms with the plant components and are connected via couplings to the plant components.

The waste removal lines for the used liquid substances preferably run vertically downward within the structural segments to rooms in the lowest story where collector tanks for waste water, used solvents and chemicals are located.

It is advantageous if the rooms of the structural segments and the mobile frames are standardized in their size. It has proven to be useful if the mobile frames are provided with wheels and can be run in and out of the rooms via extensible tracks.

The individual chemical plants in the structural segments are composed entirely or in part of module-like mobile frames which contain certain plant parts including connections and can be readily replaced as required by removing individual frames with the desired plant components from the rooms and replacing them with others. This modular design of the plant can also be limited to the plant components that are considered essential for the production.

The mobile frames are designed so that the plant parts contained in them have complete piping and wiring. The necessary connections are arranged in such a manner that a simple and rapid connection to the appropriate ring lines and distributors is possible, e.g. via flexible hose connections and in-line quick couplings or via plug contacts.

Rolling aids are used for moving the frames in and out of the mounting positions in the rooms. In the final setup position the frames are halted and connected to the building by any suitable conventional means.

BRIEF DESCRIPTION OF THE DRAWINGS

The present invention will be further understood with reference to the accompanying drawings, wherein.

DETAILED DESCRIPTION OF THE DRAWINGS

The advantages of the structure of the invention and of the arrangement of the plant components on mobile frames reside in the rapid replacement of the components during repairs or a changeover of production, in the simple expansion of the method stages by setting up additional components and in the ready possibility of checking the components for any damage.

In the case of toxic substances or if high product purity is desired, the individual frames or rooms can be protectively encased by employing additional barriers or jacketings.

The individual systems can be housed vertically superposed or horizontally adjacent to each other in the structure. The transport of the frames takes place via crane systems or other transport devices either from outside the structure via appropriate access openings or via a light well or court within the structure.

Figure 1:
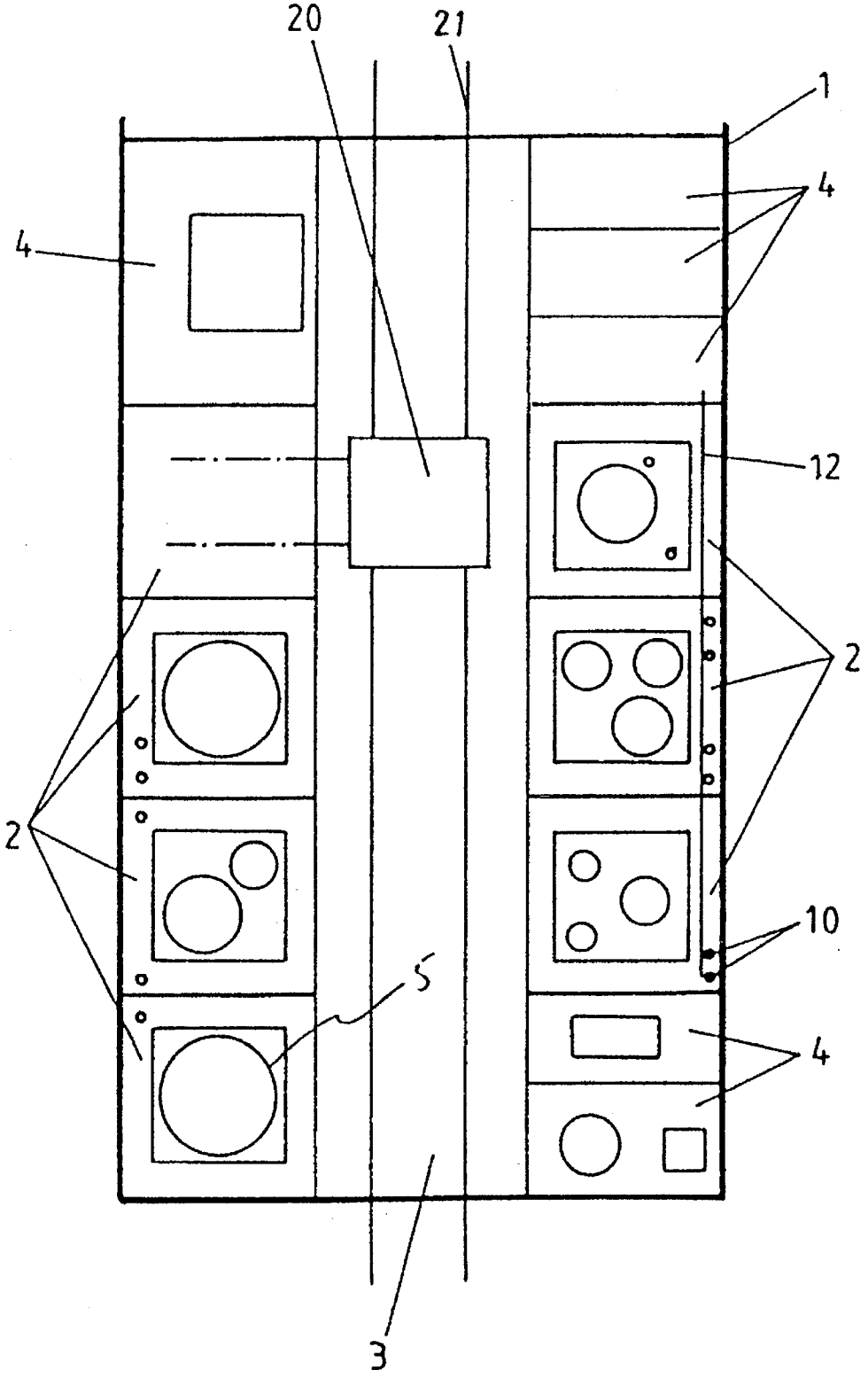
FIG. 1 is a schematic plane view of an embodiment of the multistory chemical plant structure of the invention.

In FIG. 1, several structural segments 2 which are similar in their dimensions are adjacently arranged in such a manner in a structure 1 adapted to the chemical plant that a space 3 open up to the roof is created in the middle of structure 1. A system of rails 21 can be used to move the transport system 20 horizontally and vertically. Plant components 5 such as a chemical reaction vessel, that may be required for the particular chemical process are housed within the space of these structural segments 2. All chemical and physical method steps for producing the desired product are carried out in them.

In addition to these structural segments 2 for the plant components, further structural segments 4 are present for the auxiliary devices in structure 1. The auxiliary devices serve e.g. pumps and other devices for the transport of chemicals, the collection of waste water, the preparation of solvents, the supplying of reaction media and electricity and for ventilation. These auxiliary devices service the entire structure 1.

Figure 2:
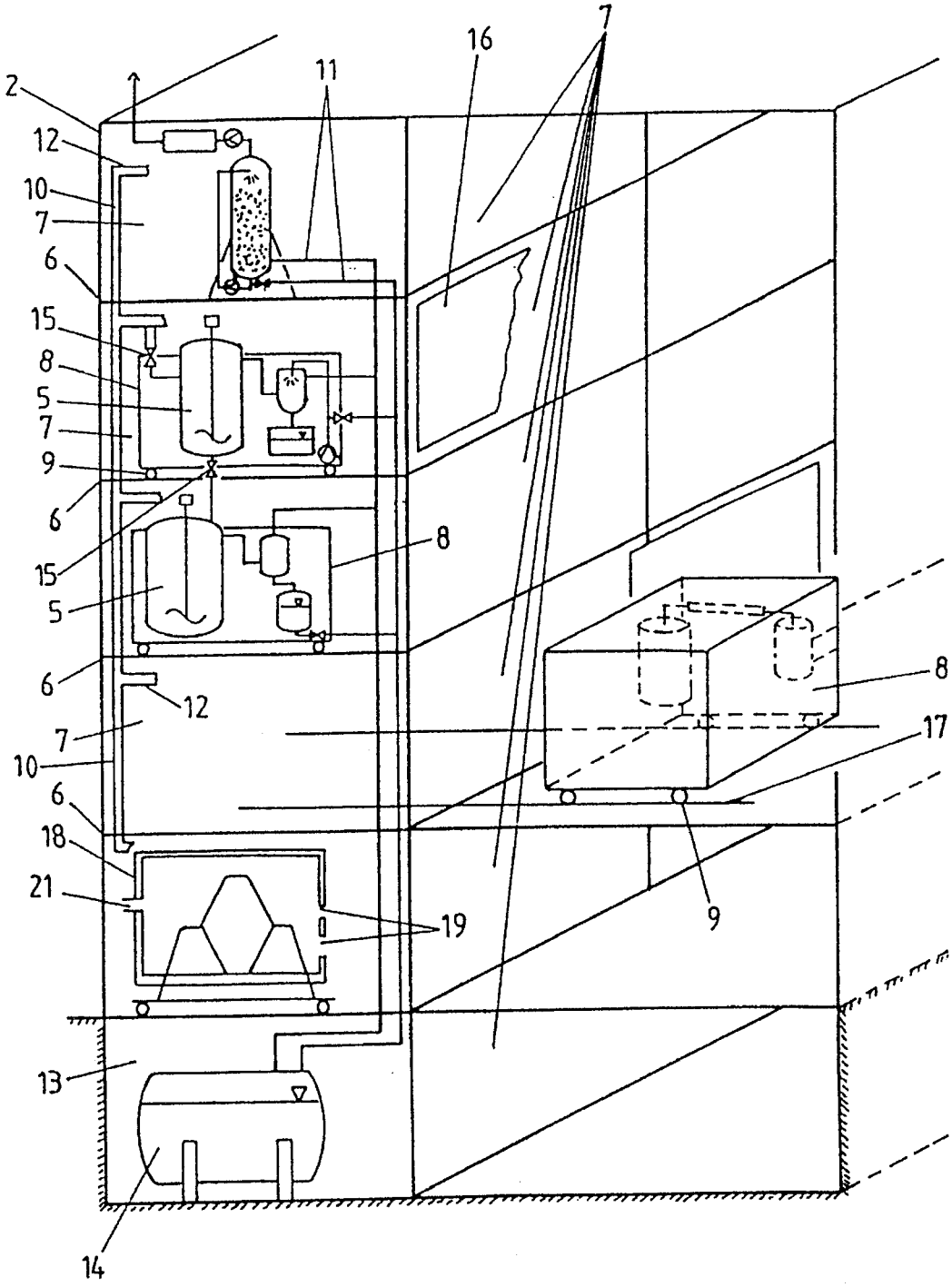
FIG. 2 is a schematic elevational view of an embodiment of the multistory chemical plant structure of the invention.

As shown in FIG. 2, structural segments 2 for the plant components are subdivided by covers or partitions 6, such as ceilings, roofs, into individual rooms 7 which are superposed and preferably have the same size. These rooms 7 contain in their totality plant components 5 necessary for the production of the desired chemical product. All or at least the most important plant components 5 are housed within mobile frames 8. These frames 8 are preferably provided with rollers 9 or wheels and always contain plant components 5 together with the necessary connections. The mobile frames are preferably rectilinear modules formed of any suitable material.

Structural segments 4 for the auxiliary devices contain vertically located supply 10 lines and, if required, product or waste removal lines 11 connected in tiers to horizontally running ring lines 12. These connections preferably take place by means of in-line quick connections 15, flexible hose connections or plug connections. Removal lines 11 can also be housed inside structural segments 2 for the plant components. They then run to rooms 13 in the lowest story of structural segment 2 in which rooms collector tanks 14 for e.g. waste water, used solvents and used chemicals are housed.

Mobile frames 8 are preferably moved in and out via access openings 16 of individual rooms 7 via tracks 17.

Plant components 5 in which toxic substances are handled or whose products require a high degree of purity receive an additional casing 18 of preferably transparent material which is connected via connection 21 to the exhaust system so that an escape of poisonous substances is prevented. Casing 18 can comprise handling openings 19.

The moving of mobile frames 8 into and out of rooms 7 takes place via transport systems 20 which can be moved horizontally and vertically.

Further variations and modifications will be apparent to those skilled in the art from the foregoing and are intended to be encompassed by the claims appended hereto.

German priority application P 42 18 615.3 is relied on and incorporated herein by reference.

We claim:

1. A multistory modular structure having an upper story and a lowest story for a chemical plant for production of a chemical product made from a supply of reaction media and using energy, comprising a plurality of partitions defining a wall, floor and ceiling and subdividing a space into a plurality of rooms superposed to accommodate a plurality of structural segments which structural segments are modules containing all plant components necessary for production of said product to be produced in said chemical plant and are provided with access openings, wherein at least a part of the plant components (5) have associated connections for supply lines for supply of the reaction media and energy as well as associated connections for removal of used liquid and gaseous substances as waste formed in the course of production of said chemical product, said plant components being mounted on casings on wheeled mobile frames (8) which can be moved in and out of said rooms (7) through access openings by extensible tracks (17), said multistory structure further containing at least one auxiliary device selected from the group consisting of means for supplying ventilation to said space, means for purification of said gaseous substance, means for supply of solvents said multistory structure further containing supply lines (10) running vertically and connected to horizontal ring lines (12) which are arranged in tiers in said rooms (7) with the plant components and are connected via couplings (15) to the plant components (5), said mobile frame having complete piping and wiring for connection to said ring lines, whereby production changes to produce different chemical products are possible with little expenditure of personnel and time to permit simple cleaning of plant components and rapid replacement of components.

2. The structure according to claim 1, further comprising removal lines (11) for the used liquid substances running vertically downward within the structural segments (2) to rooms (13) in the lowest story of said multistory structure to collector tanks (14) for waste water, used solvents and chemicals.

3. The structure according to claim 1, wherein the rooms (7) of the structural segments (2) and the mobile frames (8) are standardized in their size.

* * * * *